US005772309A

United States Patent [19]

Groben

[11] Patent Number: 5,772,309

[45] Date of Patent: Jun. 30, 1998

[54] FLASHLIGHT AND CHARGING SYSTEM

[75] Inventor: Steven J. Groben, Escondido, Calif.

[73] Assignee: Sunbrite Industries, Rohnert Park, Calif.

[21] Appl. No.: 559,775

[22] Filed: Nov. 15, 1995

[51] Int. Cl.[6] ..... F21L 7/00

[52] U.S. Cl. ..... 362/183; 362/206; 362/202

[58] Field of Search ..... 362/183, 196, 362/206, 202

[56] References Cited

U.S. PATENT DOCUMENTS

| | | | |
|---|---|---|---|
| 3,829,676 | 8/1974 | Nelson et al. | 362/183 |
| 4,092,580 | 5/1978 | Prinsze | 320/2 |
| 4,530,039 | 7/1985 | Shin-Shi | 362/202 |
| 4,949,231 | 8/1990 | Wang | 362/183 |
| 5,193,898 | 3/1993 | Maglia et al. | 362/183 |
| 5,287,257 | 2/1994 | Schier et al. | 362/206 |

*Primary Examiner*—Carroll B. Dority

*Attorney, Agent, or Firm*—Skjerven, Morrill, MacPherson, Franklin & Friel; Michael K. Bosworth

[57] ABSTRACT

A flashlight and charging system includes a flashlight having a body with a rearward end portion and a forward end portion, and a charging/mounting rack with a base, a first contact in the form of a clip adapted to engage the body of the flashlight, and a second contact adapted to face the rearward end portion of the body. The body of the flashlight includes an electrically conductive annular surface on the forward end portion of the body that is connected to a first terminal on the battery pack. It contacts the clip on the charging/mounting rack when the flashlight is held by the rack. The flashlight also includes a switch assembly mounted on the rearward end portion of the body for enabling a user to turn the flashlight on and off in a user selected one of intermittent operation and continuous operation. The switch includes a depressible, electrically conductive button member connected to a second terminal on the battery pack. It contacts the second contact of the charging/mounting rack when the flashlight is held by the rack. One embodiment includes a sectionalized body that enables the user to unscrew one section in order to convert the flashlight to use with a different size battery pack.

9 Claims, 2 Drawing Sheets

FLASHLIGHT AND CHARGING SYSTEM

BACKGROUND OF THE INVENTION

1. Technical Field

This invention relates generally to flashlights, and more particularly to a flashlight and charging system featuring rugged, convertible construction suited to law enforcement, military, and various other applications.

2. Description of Related Art

First consider a typical flashlight application in which a policeman uses his flashlight to illuminate a potential target of interest. He grasps his revolver in the right hand and the flashlight in the left hand. He grasps the flashlight in such a way that his thumb is near the rearward or handle end of the flashlight body and his little finger is toward the forward or bulb end. He then lays his right wrist across his left wrist to help steady the revolver. As he does so, he points both the flashlight and the revolver at the potential target.

Poised that way, the policeman wants to flick the flashlight on and off quickly and easily at just the right time. But the on-off switch arrangement on some flashlights frustrates the effort because they are not positioned correctly on the flashlight body and/or do not operate the way desired. The same problem affects pilots and other military personnel who need to hold and operate a flashlight intermittently while grasping the flashlight body in one hand with the thumb furthest the lightbulb end. Thus, many users need a flashlight designed to better facilitate such operation.

Recharging the flashlight batteries presents other problems. The batteries must first be removed from some existing flashlights for recharging. Other existing flashlight designs are intended for recharging while on duty within a patrol car, aircraft, or other vehicle. In addition, the way some flashlights are carried within a vehicle fails to keep them readily available for use. Thus, users need a better flashlight design addressing those concerns also.

Yet another problem concerns flashlight applications for which non-rechargeable batteries are preferred. Manufacturing and stocking two different flashlight designs, one for rechargeable batteries (e.g., nicad batteries) and another for non-rechargeable batteries (e.g., lithium batteries) adds cost. Thus, manufacturers, sales outlets, and users would benefit from a flashlight design that works with either type battery.

SUMMARY OF THE INVENTION

This invention alleviates the problems outlined above by providing a flashlight and rack charging system having a combination of desirable features. A preferred embodiment includes a momentary button switch advantageously positioned on the rearward or handle end of the flashlight body to enable operation with the user's thumb. Depressing the switch intermittently produces intermittent on and off operation. Rotating the switch produces continuous on and off operation.

The system includes a mounting rack suitable for in-vehicle use, and the mounting rack includes a battery charger. The momentary button switch is electrically conductive and arranged to serve as an exposed charging contact on the flashlight that connects one battery terminal to the charger whenever the flashlight is placed in the mounting rack. An exposed electrically conductive annular surface toward the lightbulb end of the flashlight body connects the other battery terminal, quickly and conveniently.

In addition, the flashlight body is sectionalized. It includes a removable section that can be unscrewed to shorten the body. Doing so quickly and conveniently converts the flashlight from nicad to lithium batteries at far less cost.

Thus, the invention enables a policeman, pilot, or other user to flick the flashlight on and off quickly and easily at just the right time by depressing a momentary button with the thumb. The mounting rack charges the battery pack within the flashlight while keeping the flashlight readily available in patrol cars, aircraft, and other vehicles. Use at home or the workplace is equally convenient using an AC adapter connected to the mounting rack, and convertibility from rechargeable batteries of one size to non-rechargeable batteries of another size increases functionality while keeping cost down.

In terms of some of the claim language subsequently presented, a flashlight and mounting rack system constructed according to the invention includes a flashlight having a body with a rearward and forward end that is adapted to hold a battery pack (i.e., a power supply having one or more batteries), and charging means for both charging the battery pack while the battery pack is held within the body of the flashlight and for removably holding the flashlight on a support surface.

The charging means includes a base and first and second contacts on the base. They serve to electrically connect the charging means to first and second terminals on the battery pack when the flashlight is held by the charging means. The first contact includes an electrically conductive clip adapted to engage the body of the flashlight, and the second contact includes an electrically conductive member adapted to face the rearward end of the body.

The body of the flashlight includes an electrically conductive annular surface for electrically connecting the first contact of the charging means to the first terminal on the battery pack. The electrically conductive annular surface is disposed in a position on the forward end portion of the body of the flashlight. There, it contacts the electrically conductive clip of the charging means when the flashlight is held by the charging means.

The flashlight also includes a switch assembly mounted on the rearward end portion of the body for enabling a user to turn the flashlight on and off in a user selected one of intermittent operation and continuous operation. The switch assembly includes a depressible, electrically conductive button member for electrically connecting the second contact of the charging means to the second terminal on the battery pack. The button member is electrically connected to the second terminal on the battery pack and it is disposed in a position on the rearward end portion of the body of the flashlight. There, it contacts the second contact of the charging means when the flashlight is held by the charging means.

Preferably fabricated from anodized aluminum, the flashlight and charging system of this invention overcomes many existing problems while providing rugged functionality. The following illustrative drawings and detailed description make the foregoing and other objects, features, and advantages of the invention more apparent.

DESCRIPTION OF THE PREFERRED EMBODIMENTS

Figure 1:
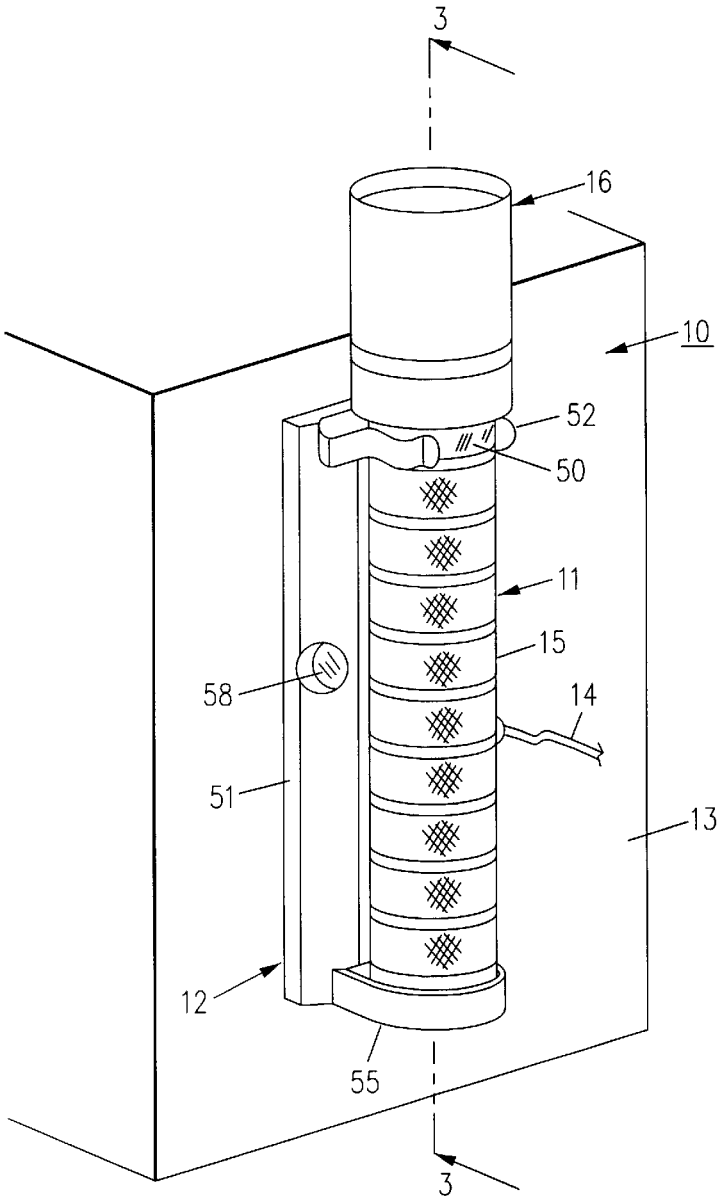
FIG. 1 of the drawings is a three-dimensional view of a flashlight and charging rack system constructed according to the invention.

FIG. 1 of the drawings shows a flashlight and charger system 10 constructed according to the invention. It includes a flashlight 11 and a charging/mounting rack 12 (or just rack 12). The rack 12 mounts on a vertical support surface 13 by screws, glue, or other suitable means and it connects via a cord 14 to a source of electrical power. There, it serves to hold the flashlight 11 in a readily accessible position during periods of nonuse while keeping a battery pack within the flashlight 11 fully charged.

In one application of the system 10, for example, the vertical support surface 13 is the side of a radio, computer display, or other piece of equipment in a patrol car. The cord 14 connects the rack 12 to the patrol car battery for power. In another application, the surface 13 is a wall or the side of an appliance in the home, and the cord 14 is the 12-volt output of a 120-volt AC adapter that plugs into a 110-volt wall outlet.

As an idea of size, the flashlight 11 has an overall length of about 6.75 inches. A cylindrically shaped handle or body 15 is about one inch in outside diameter over most of its length, and a lightbulb assembly 16 is about 1.15 inches in diameter. The charging/mounting rack 12 is dimensioned accordingly, with an overall length of about 5.5 inches. Of course, those dimensions may vary without departing from the inventive concepts disclosed.

Figure 2:
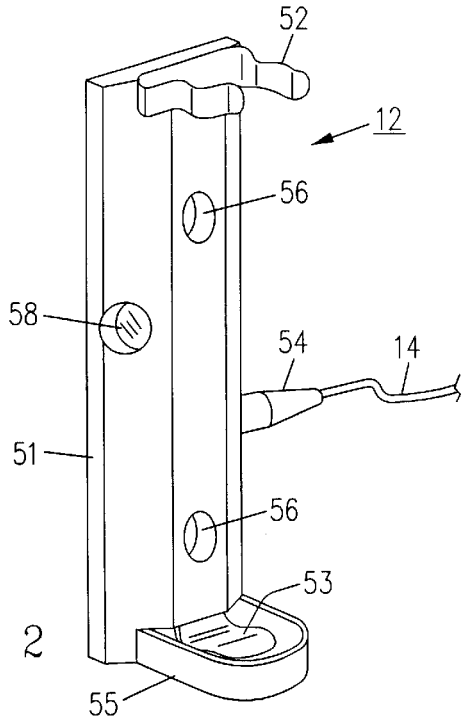
FIG. 2 is a three-dimensional view of just the charging rack with the flashlight removed.
Figure 3:
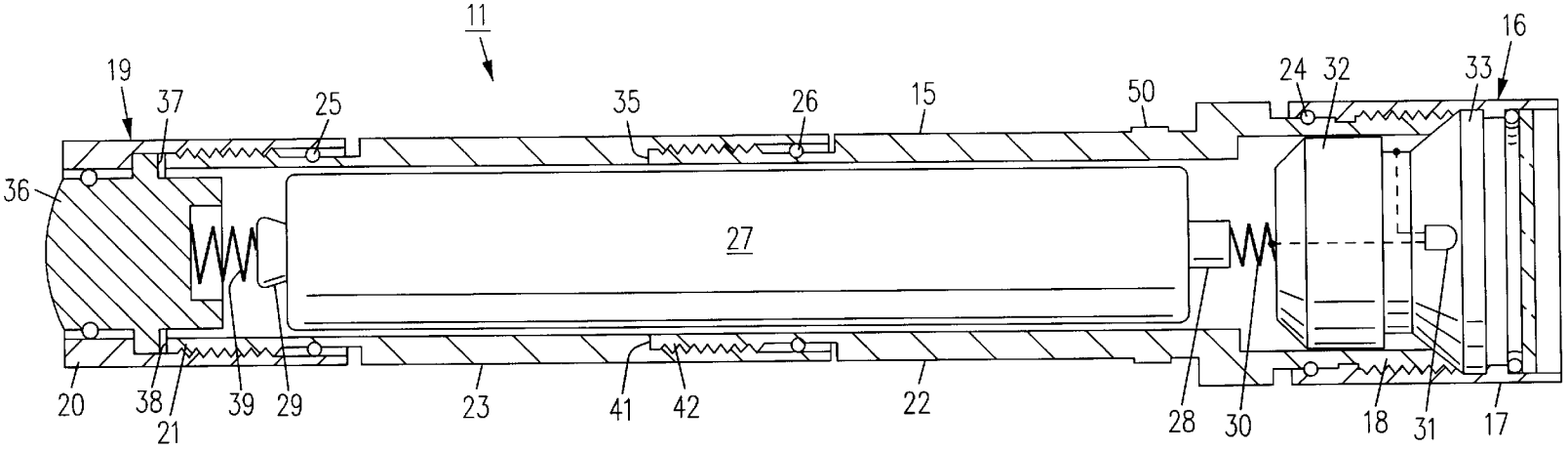
FIG. 3 is an enlarged cross sectional view of the flashlight taken on line 3—3 of FIG. 1 through the longitudinal axis of the flashlight, with lightbulb connections indicated diagrammatically.
Figure 5:
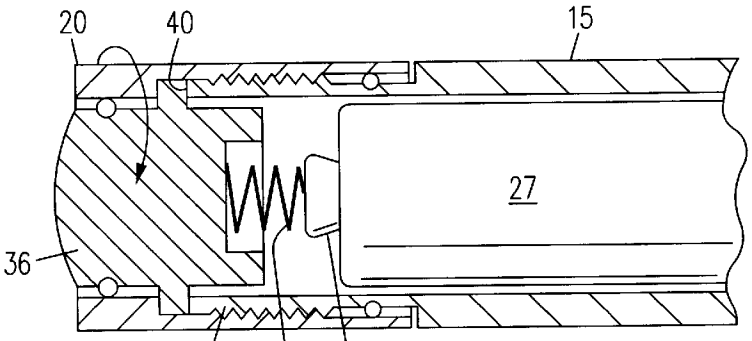
FIG. 5 is an enlarged cross sectional view similar to FIG. 4 showing continuous action of the on-off switch.
Figure 4:
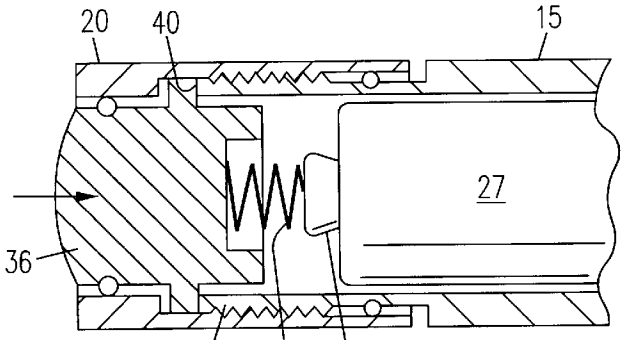
FIG. 4 is a further enlarged cross sectional view of the handle end of the flashlight showing momentary action of the on-off switch.

Further details are shown in FIGS. 2–5. The lightbulb assembly 16 includes a head cap 17 that screws onto a forward end portion 18 of the body 15 (FIG. 3). A switch assembly 19 includes an end cap 20 that screws onto a rearward end portion 21 of the body 15 (FIGS. 3–5). The body 15 includes a main section 22 and an extension section 23, and those two sections screw together. Numerals 24–26 designate O-rings.

The head cap 17, end cap 20, and both the main and the extension sections 22 and 23 are fabricated from aluminum and given an electrically nonconductive surface treatment (e.g., black anodized). That results in the surfaces of those components being nonconductive except for certain areas (subsequently described) in which the surface treatment is omitted (or removed as part of component fabrication).

The body 15 includes a hollow interior with an inside diameter measuring about 0.70 inch. A battery pack 27 (e.g., four 1.5-volt nicad batteries in a plastic sleeve of shrink tubing) with a slightly smaller outside diameter and a 4.7 inch overall length (including its positive terminal 28 and its negative terminal 29) fits within the body 15 (FIG. 3).

Current flowing from the positive terminal 28 of the battery pack 27 passes through an electrically conductive spring 30 to a lamp 31. The lamp 31 is depicted diagrammatically in FIG. 3 and the dashed lines depict the flow of current from the spring 30 along a wire within an insulated component 32 to the lamp 31 and then through the lamp 31 to an electrically conductive reflector component 33.

From the reflector component 33, current flows into the forward end portion of the body 15 by virtue of an exposed annular surface 34 on the forward end portion 18. In other words, the nonconductive coating over most of the body 15 does not exist on the surface 34. It was omitted or removed during fabrication. The reflector component 33 contacts that surface as illustrated in FIG. 3, and that electrically connects the reflector component 33 to the main section 22 of the body 15.

The main section 22 electrically connects to the extension section 23 by virtue of exposed electrically conductive surfaces at the interface 35 of the main and the extension sections. When the two sections 22 and 23 are screwed together, a rearwardly facing annular surface on the main section 22 having no nonconductive coating contacts a forwardly facing annular surface on the extension section 23 having no nonconductive coating.

The switch assembly 19 includes a button member 36 formed of an electrically conductive material (e.g., aluminum) that works in somewhat the same way. It completes the electrical circuit when it is moved forwardly into contact with an electrically conductive surface on the body 15 to turn the flashlight 10 on (i.e., supply current to the lightbulb 31). The button member 36 includes a forwardly facing, electrically conductive annular surface 37 that contacts a rearwardly facing, electrically conductive annular surface 38 on the rearward end portion of the body 15 when the button member 36 is moved forwardly sufficiently. An electrically conductive spring 39 spring biases the button member 36 rearwardly (i.e., away from the body 15 while electrically connecting the button member 36 to the negative terminal 29 of the battery pack 27.

A user moves the button member 36 forwardly for intermittent, momentary operation by depressing it (e.g., with the user's thumb). That mode of operation is illustrated in FIG. 4. The arrow in FIG. 4 depicts the user action that moves the button member 36 forwardly to achieve electrically contact at the interface 40 of the button member 36 and the rearward end portion 21 of the body 15.

A user moves the button member 36 forwardly for continuous operation by screwing the end cap 20 on tightly. That mode of operation is illustrated in FIG. 5. The arrow in FIG. 5 depicts the user action that screws the end cap 20 on to move the button member 36 forwardly and achieve electrical contact at the interface 40 of the button member 36 and the rearward end portion 21 of the body 15.

To convert the flashlight 10 to use with smaller batteries (e.g., lithium batteries), the user unscrews the end cap 20 from the extension section 23, removes the battery pack 27, and unscrews the extension section 23 from the main section 22. He then places the smaller battery pack into the main section 22 and screws the end cap 20 onto the main section 22. In that configuration, the forwardly facing annular surface 37 on the button member 36 contacts an electrically conductive, rearwardly facing annular surface 41 (FIG. 3) on a rearward end portion 42 of the main section 22 to form an electrically conductive interface like the interface 40 in FIGS. 4 and 5.

The button member 36 combines with an electrically conductive exposed annular surface 50 on the main section 22 (FIG. 3) to facilitate charging. In that regard, the rack 12 includes a base 51, a first electrical contact or resiliently deformable metal clip 52 mounted on the base, and a second electrical contact or resiliently deformable metal leaf spring contact 53 (FIG. 2). A conventional jack 54 located on the cord 14 connects the cord 14 to the clip 52 and the leaf spring contact 53. Placing the flashlight 10 in the rack in the position shown in FIG. 1, results in the clip 52 contacting the annular surface 50 on the body 15 to electrically connect the charging/mounting rack 12 to the positive terminal 28 through the lightbulb 31. It also causes the leaf spring contact 53 to contact the button member 36 to electrically connect the charging/mounting rack 12 to the negative terminal 29.

A retainer member 55 on the base 51 helps hold the flashlight 10 in position. Screw holes 56 and 57 enable use of screws as a means of mounting the base 51 on a vertical surface. An indicator light 58 connected to the cable 14 in a known way indicates when the charging/mounting rack 12 is charging the battery pack.

Thus, the invention provides a flashlight and charging system that enables a policeman, pilot, or other user to flick the flashlight on and off quickly and easily at just the right time by depressing a momentary button with the thumb. The mounting rack charges the battery pack within the flashlight while keeping the flashlight readily available in patrol cars, aircraft, and other vehicles. Use at home or the workplace is equally convenient using an AC adapter connected to the mounting rack, and convertibility from rechargeable batteries of one size to non-rechargeable batteries of another size increases functionality while keeping cost down. Although an exemplary embodiment has been shown and described, one of ordinary skill in the art may make many changes, modifications, and substitutions without necessarily departing from the spirit and scope of the invention.

What is claimed is:

1. A flashlight and charging system, comprising:

a flashlight having a body adapted to hold a battery pack within the body, the body of the flashlight having a rearward end portion and a forward end portion; and charging means for charging the battery pack while the battery pack is held within the body of the flashlight and for removably holding the flashlight on a support surface;

the charging means including a base and means in the form of first and second contacts on the base for electrically connecting the charging means to respective ones of a first terminal and a second terminal on the battery pack when the flashlight is held by the charging means, the first contact including an electrically conductive clip adapted to engage the body of the flashlight, and the second contact including an electrically conductive member adapted to face the rearward end of the body;

the body of the flashlight including means in the form of an electrically conductive annular surface for electrically connecting the first contact of the charging means to the first terminal on the battery pack, the electrically conductive annular surface being disposed in a position on the forward end portion of the body of the flashlight adapted to cause the electrically conductive annular surface to contact the electrically conductive clip of the charging means when the flashlight is held by the charging means;

the flashlight including means in the form of a switch assembly mounted on the rearward end portion of the body for enabling a user to turn the flashlight on and off in a user selected one of intermittent operation and continuous operation; and the switch assembly including means in the form of a depressible, electrically conductive button member for electrically connecting the second contact of the charging means to the second terminal on the battery pack, the button member being electrically connected to the second terminal on the battery pack and disposed in a position on the rearward end portion of the body of the flashlight adapted to cause the button member to contact the second contact of the charging means when the flashlight is held by the charging means.

2. A flashlight and charging system as recited in claim 1, wherein the flashlight body includes means in the form of a removably section for enabling the user to convert the flashlight to use with a different size battery pack.

3. A flashlight and charging system as recited in claim 1, wherein the charging means includes an indicator light.

4. A flashlight and charging system as recited in claim 1, wherein the charging means includes an AC adaptor.

5. A flashlight, comprising:

a body member adapted to hold a battery pack, the body member having a rearward end portion and a forward end portion;

a lightbulb assembly removably mounted on the forward end portion of the body member; and means in the form of a switch assembly removably mounted on the rearward end portion of the body member for enabling a user to turn the flashlight on and off in a user selected one of intermittent operation and continuous operation;

the body member including means in the form of an electrically conductive annular surface for electrically connecting a first contact of a battery charging means to the first terminal on the battery pack, the electrically conductive annular surface being disposed in a position on the forward end portion of the body member adapted to cause the electrically conductive annular surface to contact the first contact of the battery charging means when the flashlight is held by the battery charging means;

the switch assembly including means in the form of an electrically conductive button member for enabling the user to operate the switch and for electrically connecting a second contact of the battery charging means to a second terminal on the battery pack, the button member being electrically connected to the second terminal on the battery pack and disposed in a position on the rearward end portion of the body member adapted to cause the button member to contact the second contact of the battery charging means when the flashlight is held by the battery charging means.

6. A flashlight as recited in claim 5, wherein the body member includes means in the form of a removably section for enabling the user to convert the flashlight to use with a different size battery pack.

7. A flashlight, comprising:

a body member having a rearward end portion and a forward end portion;

a lightbulb assembly removably mounted on the forward end portion of the body member; and a switch assembly removably mounted on the rearward end portion of the body member;

the switch assembly including means in the form of an electrically conductive button member in an exposed position on the rearward end portion of the body member for enabling a user to close the switch by depressing the button member and for electrically connecting a contact of a battery charger to a terminal on a battery pack within the body member.

8. A flashlight as recited in claim 7, wherein the body member includes means in the form of an electrically conductive annular surface for electrically connecting another contact of the battery charger to another terminal on the battery pack.

9. A flashlight as recited in claim 7, wherein the body member includes means in the form of a removably section for enabling the user to convert the flashlight to use with a different size battery pack.

* * * * *